US007736285B2

(12) United States Patent
Brown, Jr.

(10) Patent No.: US 7,736,285 B2
(45) Date of Patent: Jun. 15, 2010

(54) PORTABLE EXERCISE DEVICE

(76) Inventor: Edward Brown, Jr., 17721 NW. 14th Ct., Miami, FL (US) 33169

( * ) Notice: Subject to any disclaimer, the term of this patent is extended or adjusted under 35 U.S.C. 154(b) by 2 days.

(21) Appl. No.: 12/134,306

(22) Filed: Jun. 6, 2008

(65) Prior Publication Data

US 2009/0305854 A1 Dec. 10, 2009

(51) Int. Cl.
*A63B 21/02* (2006.01)

(52) U.S. Cl. ..... 482/121; 482/140; 482/79

(58) Field of Classification Search ..... 482/79–80, 482/124, 83–90, 121–130, 146, 34, 139, 482/148

See application file for complete search history.

(56) References Cited

U.S. PATENT DOCUMENTS 3,295,847 A * 1/1967 Matt, Sr. ..... 482/80
3,421,760 A * 1/1969 Freeman, Jr. ..... 482/80
3,664,666 A * 5/1972 Lloyd ..... 482/133
5,607,377 A * 3/1997 Wilkinson ..... 482/83
5,941,802 A * 8/1999 Kiser ..... 482/92
7,235,039 B2 * 6/2007 Anders ..... 482/51
2006/0247106 A1 * 11/2006 Peavey ..... 482/83

* cited by examiner

*Primary Examiner*—Lori Baker
(74) *Attorney, Agent, or Firm*—Jerry D. Haynes, Esq.

(57) ABSTRACT

A portable exercise device, for use in exercising an abdominal portion and a lower portion of a body, includes a base, a frame assembly and an exercising assembly. The frame assembly is detachably coupled to the base. The frame assembly includes a first support member and a second support member. The second support member is coupled to the first support member for configuring an intermediate support member therebetween. The exercising assembly includes a first stretchable member coupled to the first support member and the intermediate support member, a first platform coupled to the first stretchable member, a second stretchable member coupled to the second support member and the intermediate support member, and second platform coupled to the second stretchable member. The portable exercise device further includes a fastening mechanism configured on each of the first platform and the second platform.

8 Claims, 5 Drawing Sheets

PORTABLE EXERCISE DEVICE

FIELD OF THE INVENTION

The present invention relates generally to exercise devices, and, more particularly, to an exercise device that may be conveniently carried by a user.

BACKGROUND OF THE INVENTION

These days more and more people are becoming fitness conscious, and therefore, people exercise on a routine basis to stay healthy and fit. Many types of physical exercises are done by people, for example, push-ups, walking briskly, weight-lifting, and the like.

Typically, people utilize various exercise devices to workout extra fat accumulated in certain body portions thereof. For example, bicycling exercise devices (hereinafter referred to as exercise devices) are normally used for to workout the abdominal portion and the thigh portions of the body. However, conventional exercise devices include complex configuration mechanism. Accordingly, such exercise devices require substantial amount of time for configuration thereof before such device may be utilized for the purpose of exercising. Additionally, such exercise devices are bulky in construction, and requires sizeable space for storage thereof. Moreover, conventional exercise devices are expensive.

Accordingly, there exists a need for a portable exercise device that may be easily configured by a user to workout an abdominal portion and a lower portion of a body. Further, there exists a need for a portable exercise device that may be conveniently carried by a user for usage thereof. Furthermore, there exists a need for a portable exercise device that may be conveniently stored after the usage thereof.

SUMMARY OF THE INVENTION

In view of foregoing disadvantages inherent in the prior art, the general purpose of the present invention is to provide a portable exercise device configured to include all the advantages of the prior art, and overcome the drawbacks inherent therein.

Accordingly, an object of the present invention is to provide a portable exercise device that may be easily configured to workout an abdominal portion and a lower portion of a body.

Another object of the present invention is to provide a portable exercise device that may be conveniently carried by a user from one place to another.

Yet another object of the present invention is to provide a portable exercise device that may be stored conveniently after usage thereof.

In light of the above objects, in one aspect of the present invention, a portable exercise device is disclosed. The portable exercise device includes a base, a frame assembly and an exercising assembly. The frame assembly is detachably coupled to the base. The frame assembly includes a first support member and a second support member. The second support member is coupled to the first support member for configuring an intermediate support member therebetween. The intermediate support member extends vertically towards the base. The exercising assembly includes a first stretchable member, a first platform, a second stretchable member and a second platform. The first stretchable member is coupled to the first support member and the intermediate support member. Further, the first platform is coupled to the first stretchable member. Furthermore, the second stretchable member is coupled to the second support member and the intermediate support member. Moreover, the second platform is coupled to the second stretchable member.

In another aspect of the present invention, the portable exercise device further includes a fastening mechanism configured on each of the first platform and the second platform for removably securing a foot of a user thereto.

These together with other aspects of the present invention, along with the various features of novelty that characterize the present invention, are pointed out with particularity in the claims annexed hereto and form a part of this present invention. For a better understanding of the present invention, its operating advantages, and the specific objects attained by its uses, reference should be made to the accompanying drawings and descriptive matter in which there are illustrated exemplary embodiments of the present invention.

BRIEF DESCRIPTION OF THE DRAWINGS

The advantages and features of the present invention will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE INVENTION

The exemplary embodiments described herein detail for illustrative purposes and are subject to many variations in structure and design. It should be emphasized, however, that the present invention is not limited to a portable exercise device, as shown and described. It is understood that various omissions and substitutions of equivalents are contemplated as circumstances may suggest or render expedient, but these are intended to cover the application or implementation without departing from the spirit or scope of the claims of the present invention. Also, it is to be understood that the phraseology and terminology used herein is for the purpose of description and should not be regarded as limiting.

The terms "first," "second," and the like, herein do not denote any order, quantity, or importance, but rather are used to distinguish one element from another. The terms "a" and "an" herein do not denote a limitation of quantity, but rather denote the presence of at least one of the referenced item.

The present invention provides a portable exercise device which may be used for exercising an abdominal portion and a lower portion of a body, such as thigh portion of legs. The portable exercise device may be conveniently carried by a user from one place to another and may be easily configured for exercising. More specifically, the present invention provides a portable exercise device that is light weight and simple in construction, thereby enabling easy configuration thereof for doing exercise.

Figure 1:
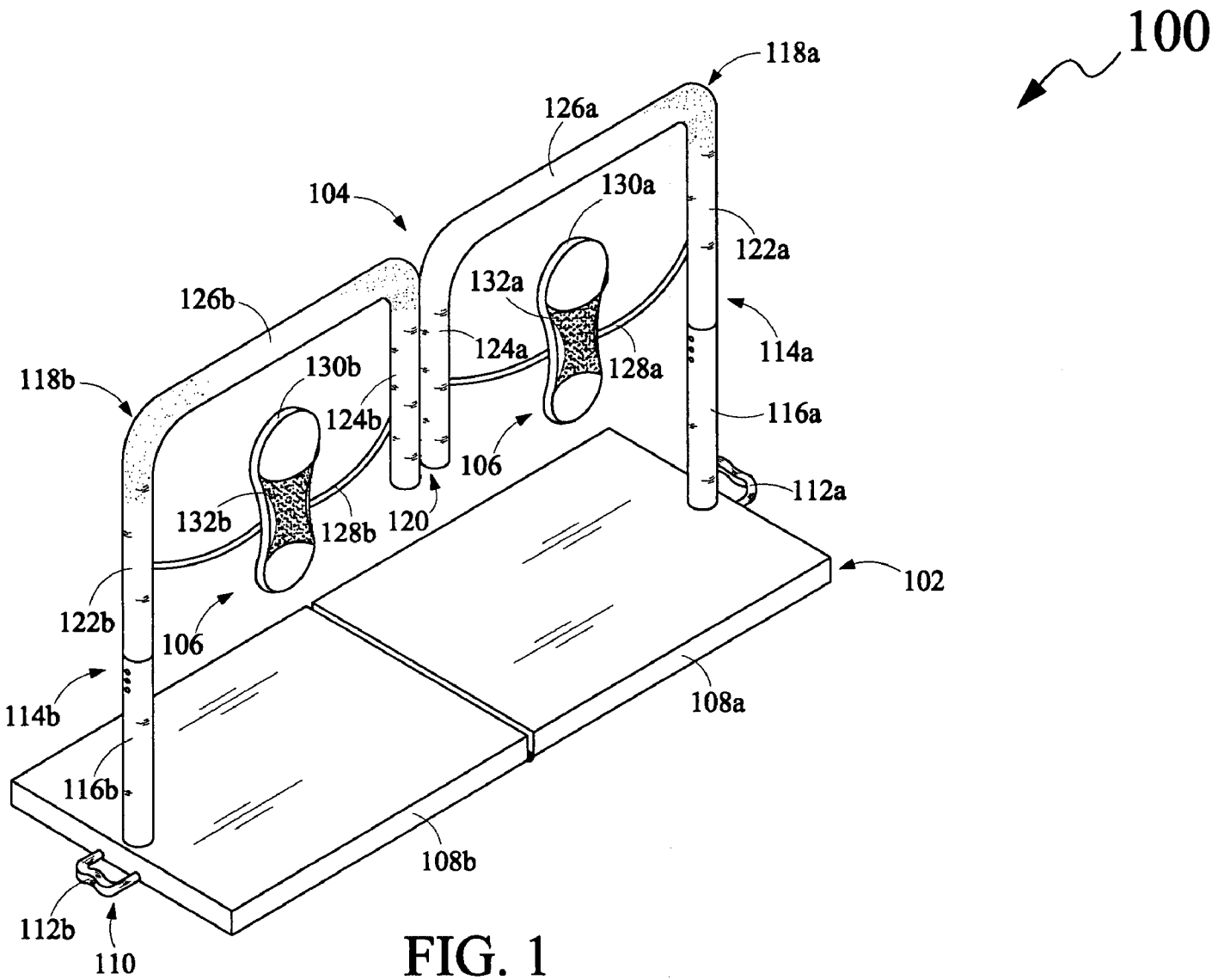
FIG. 1 illustrates a perspective view of a portable exercise device, in accordance with an exemplary embodiment of the present invention.

Referring to FIG. 1, a perspective view of a portable exercise device 100 (herein after referred to as device 100) is illustrated, in accordance with an exemplary embodiment of the present invention. The device 100 includes a base 102, a frame assembly 104 and an exercising assembly 106.

In the present embodiment, the base 102 is depicted as rectangular elongated structure (cuboidal) for the purpose of illustration only. However, it will be apparent to a person skilled in the art that the base 102 may be configured to assume any other shapes apart from the rectangular elongated structure, such as a circular elongated structure, an elliptical elongated structure and a polygonal elongated structure. The base 102 includes a first base portion 108*a*, a second base portion 108*b* and a hinge arrangement (not shown) configured between the first base portion 108*a* and the second base portion 108*b*. More specifically, the first base portion 108*a* is positioned adjacent to the second base portion 108*b* with the hinge arrangement configured therebetween. The hinge arrangement is further explained in detail in conjunction with FIGS. 4 and 5.

In one embodiment of the present invention, the base 102 includes a cavity (not shown) for receiving the frame assembly 104 and the exercising assembly 106 therein. More specifically, each of the first base portion 108*a* and the second base portion 108*b* of the base 102 are configured with a cavity, capable of receiving the frame assembly 104 and the exercising assembly 106 therein. The configuration of the first base portion 108*a* and the second base portion 108*b* is further explained in detail in conjunction with FIG. 5.

The base 102 may further include a handle assembly 110 configured on the first base portion 108*a* and the second base portion 108*b*. In one embodiment of the present invention, the handle assembly 110 includes a handle 112*a* configured on the first base portion 108*a* and a handle 112*b* configured on the second base portion 108*b* for enabling a user to carry the device 100. However, it will be obvious to a person skilled in the art that the handle assembly 110 may include a single handle configured thereon instead of handles 112*a* and 112*b* configured on the base 102. Further, the base 102 may be placed on a substantially plane surface, such as a floor for supporting the device 100 thereon.

The frame assembly 104 is detachably coupled to the base 102. More specifically, the frame assembly 104 includes a first support member 114*a* and a second support member 114*b* (hereinafter collectively referred to as support members 114) detachably coupled to the base 102 and extending vertically therefrom. The coupling of the support members 114 with the base 102 will be explained in detail in conjunction with FIG. 2.

As disclosed herein, the support members 114 may assume a hollow tubular configuration, thereby imparting a light weight construction to the device 100. In one embodiment of the present invention, the support members 114 may have an inverted J-shaped structure. More specifically, each of the first support member 114*a* and the second support member 114*b* includes a straight portion and a curved portion. As illustrated in FIG. 1, the first support member 114*a* includes a first straight portion 116*a* and a first curved portion 118*a*. Similarly, the second support member 114*b* includes a second straight portion 116*b* and a second curved portion 118*b*. Further, it will be evident to person skilled in the art that the first curved portion 118*a* and the second curved portion 118*b* are inverted U-shaped structure.

In one embodiment of the present invention, the straight portion of each of the support members 114 is telescopically coupled to the curved portions thereof. More specifically, the first straight portion 116*a* and the second straight portion 116*b* may be telescopically coupled to the first curved portion 118*a* and the second curved portion 118*b*, respectively. The telescopic coupling of the first straight portion 116*a* with the first curved portion 118*a* and second straight portion 116*b* with the second curved portion 118*b* will be explained in detail in conjunction with FIG. 2. Further, the first support member 114*a* and the second support member 114*b* are coupled to configure an intermediate support member 120 therebetween. More specifically, the first curved portion 118*a* and the second curved portion 118*b* are coupled to configure the intermediate support member 120.

As disclosed herein, the first curved portion 118*a* and the second curved portion 118*b* have an inverted U-shaped structure. More specifically, the first curved portion 118*a* includes a pair of parallely spaced apart vertical links, such as a vertical link 122*a* and a vertical link 124*a*, and a horizontal link, such as a horizontal link 126*a* connecting top end portions of the vertical link 122*a* and the vertical link 124*a*. Similarly, the second curved portion 118*b* includes a pair of parallely spaced apart vertical links, such as a vertical link 122*b* and a vertical link 124*b*, and a horizontal link, such as a horizontal link 126*b* connecting top end portions of the vertical link 122*b* and the vertical link 124*b*. Accordingly, the intermediate support member 120 may be configured by laterally coupling the vertical link 124*a* and the vertical link 124*b*. It will be apparent to a person skilled in the art that the vertical link 124*a* may be coupled to the vertical link 124*b* by any arrangement known in the art without departing from teachings of the present invention. For example, the vertical link 124*a* may include a projection (not shown) and the vertical link 124*b* may include an elongated aperture (not shown) for slidably receiving and engaging the projection therein. Accordingly, for coupling the vertical link 124*a* and the vertical link 124*b*, the projection may slide within the aperture.

In one embodiment of the present invention, the intermediate support member 120 may include a swiveling mechanism (not show) configured between the vertical link 124*a* and the vertical link 124*b*. The swiveling mechanism enables the first curved portion 118*a* and the second curved portion 118*b* to move pivotally about the intermediate support member 120 upon decoupling the vertical link 124*a* and the vertical link 124*b*. Further, the swiveling mechanism enables in securing the first curved portion 118*a* with the second curved portion 118*b* upon folding the support members 114. The folded position of the support members 114 will be explained in conjunction with FIG. 4.

The intermediate support member 120 extends vertically towards the base 102. In the present embodiment, the intermediate support member 120 is assumed to be positioned above the base 102 without contacting the base 102. However, it will be evident to person skilled in the art that the intermediate support member 120 may be configured to extend vertically towards the base 102, thereby contacting the base 102. More specifically, each of the support members 114 may be configured to assume a U-shaped structure such that the intermediate support member 120 may contact the base 102. The U-shaped structure of the support members 114 may strengthen the coupling thereof with the base 102.

The exercising assembly 106 is configured to receive feet of the user, thereby enabling the user to perform exercise for abdominal portion and the thigh portions of the body. The exercising assembly 106 includes a first stretchable member 128*a*, a first platform 130*a*, a second stretchable member 128*b* and a second platform 130*b*. The first stretchable member 128*a* is coupled to the first support member 114*a*, on the vertical link 122*a*, and the intermediate support member 120. Similarly, the second stretchable member 128*b* is coupled to the second support member 114*b*, about the vertical link 122*b*, and the intermediate support member 120. Preferably, each of the first platform 130*a* and the second platform 130*b* are coupled to a middle portion of the first stretchable member 128*a*, and a middle portion of the second stretchable member 128*b*, respectively. Further, each of the first platform 130*a* and the second platform 130*b* (hereinafter collectively referred to as platforms 130) includes a fastening mechanism for removably securing the feet of the user thereon. For example, the first platform 130*a* includes a first fastening mechanism 132*a*, and the second platform 130*b* includes a second fastening mechanism 132*b*. The first fastening mechanism 132*a* and the second fastening mechanism 132*b* are hereinafter collectively referred to as fastening mechanisms 132.

In one embodiment of the present invention, the fastening mechanisms 132 may include straps configured on the platforms 130. The fastening mechanisms 132 are capable of tightly securing feet of the user on the platforms 130. Further, it will be evident to a person skilled in the art that the fastening mechanisms 132 may be any other arrangement known in the art apart from straps for securing the feet of the user on the platforms 130. For example, without limiting the scope of the present invention, the fastening mechanisms 132 may include a hook and loop arrangement, a buckle arrangement, a magnetic coupling arrangement, and the like.

Figure 2:
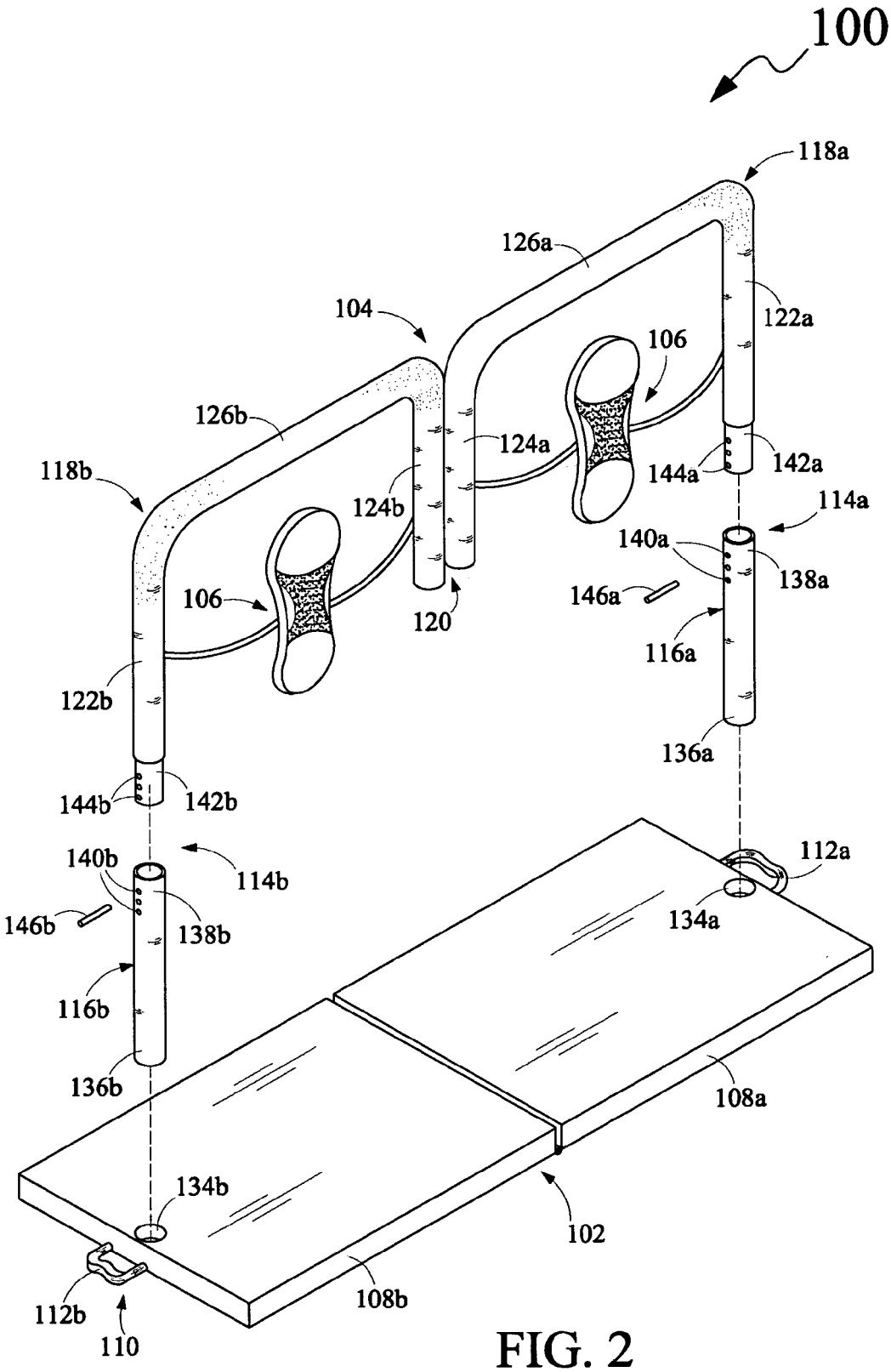
FIG. 2 illustrates an unassembled perspective view of the portable exercise device of FIG. 1, in accordance with an exemplary embodiment of the present invention.

Referring to FIG. 2, an unassembled perspective view of the device 100 of FIG. 1 is illustrated, in accordance with an exemplary embodiment of the present invention. As shown in FIG. 2, the base 102 includes a pair of apertures, such as an aperture 134*a* and an aperture 134*b* configured thereon. More specifically, the aperture 134*a* is configured on the first base portion 108*a* and the aperture 134*b* is configured on the second base portion 108*b*. The aperture 134*a* is adapted to receive a bottom end portion 136*a* of the first straight portion 116*a* for detachably coupling the first straight portion 116*a* with the first base portion 108*a*. Similarly, the aperture 134*b* is configured to receive a bottom end portion 136*b* of the second straight portion 116*b* for detachably coupling the second straight portion 116*b* with the second base portion 108*b*.

The first straight portion 116*a* and the second straight portion 116*b* are further telescopically coupled to the first curved portion 118*a* and the second curved portion 118*b*, respectively. The telescopic coupling of the first straight portion 116*a* and the second straight portion 116*b* with the first curved portion 118*a* and the second curved portion 118*b*, respectively, may be enabled by a plurality of holes configured thereon and a locking means. More specifically, a top end portion 138*a* of the first straight portion 116*a* is configured with a plurality of holes, such as holes 140*a* and a bottom end portion 142*a* of the vertical link 122*a* of the first curved portion 118*a* is configured with a plurality of holes, such as holes 144*a*. The top end portion 138*a* receives the bottom end portion 142*a* in a manner such that at least one hole of the holes 140*a* aligns with at least one hole of the holes 144*a*. Thereafter, a suitable locking means, for example, a locking pin 146*a* may be inserted through aligned holes of the holes 140*a* and holes 144*a* for coupling the top end portion 138*a* with the bottom end portion 142*a*. Further, it will be apparent to person skilled in the art that the top end portion 138*a* and the bottom end portion 142*a* may be telescopically adjusted and locked by the locking pin 146*a* to adjust a height of the first support member 114*a*.

Similarly, the second straight portion 116*b* is telescopically coupled to the second curved portion 118*b*. Specifically, a top end portion 138*b* of the second straight portion 116*b* is configured with a plurality of holes such as holes 140*b*, and a bottom end portion 142*b* of the vertical link 122*b* of the second curved portion 118*b* is configured with a plurality of holes, such as holes 144*b*. The top end portion 138*b* receives the bottom end portion 142*b* in a manner such that at least one hole of the holes 140*b* aligns with at least one hole of the holes 144*b*. Thereafter, a locking pin 146*b* may be inserted through aligned holes of the holes 140*b* and 144*b* for coupling the top end portion 138*b* with the bottom end portion 142*b*. Further, the top end portion 138*b* and the bottom end portion 142*b* may be telescopically adjusted and locked by the locking pin 146*b* to adjust a height of second support member 114*b*.

The telescopic coupling of the first straight portion 116*a* and the second straight portion 116*b* with the first curved portion 118*a* and the second curved portion 118*b*, respectively, enables in adjusting a height of the support members 114. In one embodiment of the present invention, the telescopic coupling of the support members 114 enables the support members 114 to assume a height of about five inches, thereby enabling the device 100 to be used by users of different age category, such as kids, adults and the like.

Figure 3:
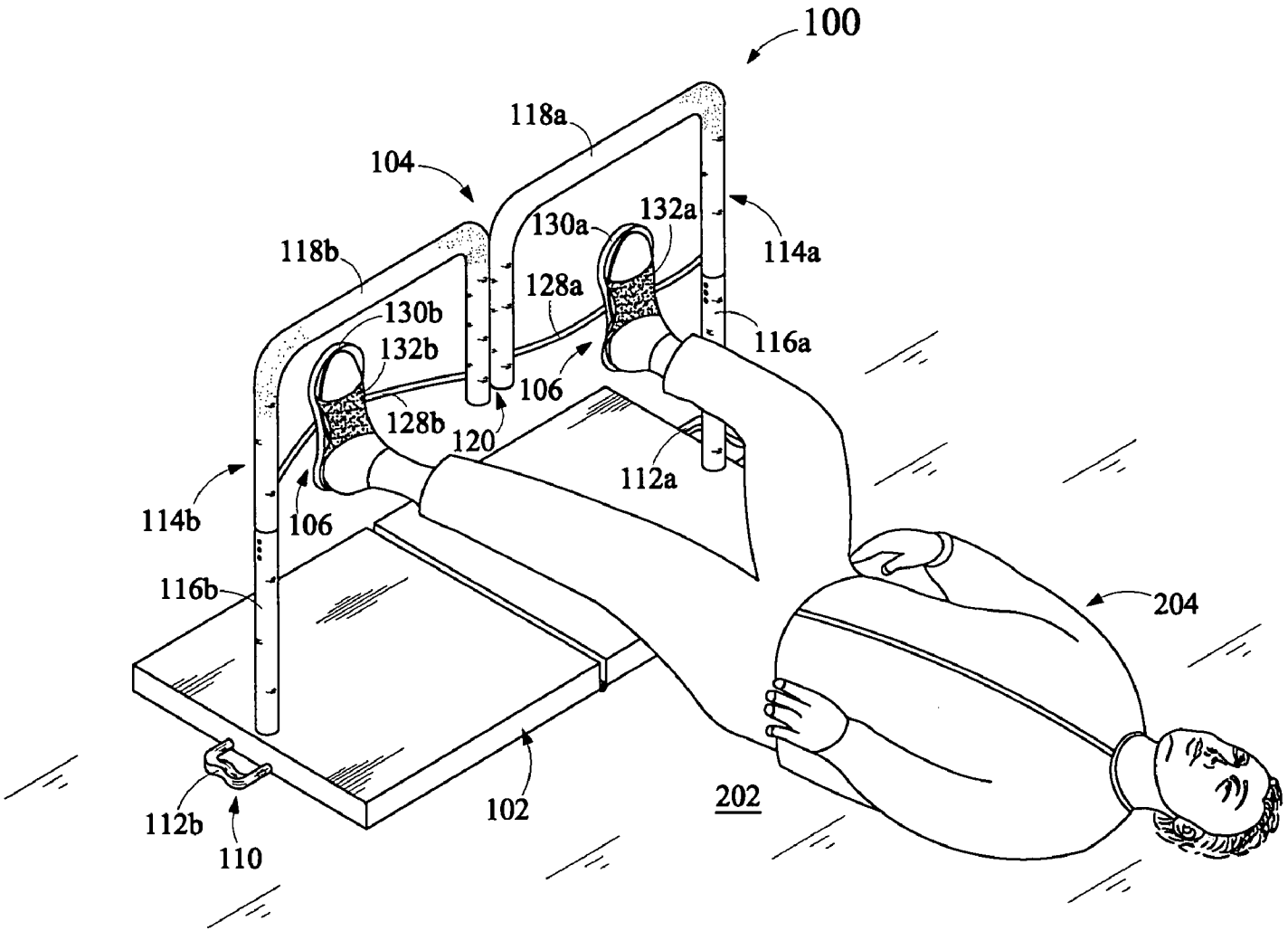
FIG. 3 illustrates an environment in which the portable exercise device of FIGS. 1 and 2 is utilized for exercising, in accordance with an exemplary embodiment of the present invention.

Referring to FIG. 3, an environment in which the device 100 of FIGS. 1 and 2 is utilized for exercising is illustrated, in accordance with an exemplary embodiment of the present invention. As shown in the FIG. 3, the device 100 may be placed on a floor 202 and a user 204 lying on his back may position the feet thereof on the first platform 130*a* and the second platform 130*b*. The feet of the user 204 may be received on the first platform 130*a* and the second platform 130*b* and removably secured thereto by the first fastening mechanism 132*a* and the second fastening mechanism 132*b*, respectively. As disclosed herein, the first fastening mechanism 132*a* and the second fastening mechanism 132*b* are straps configured on the first platform 130*a* and the second platform 130*b*, respectively. The first fastening mechanism 132*a* and the second fastening mechanism 132*b* runs over instep portions of the feet of the user 204, thereby removably securing the feet of the user 204 with the first platform 130*a* and the second platform 130*b*.

In one embodiment of the present invention, the first stretchable member 128*a* and the second stretchable member 128*b* are elastic bands, composed of a rubber material. Accordingly, the first stretchable member 128*a* and the second stretchable member 128*b* are adapted to extend and compress with a forward and a backward movement of the feet of the user 204, as shown in FIG. 3. On repeating the forward and the backward movement of the feet, the device 100 enables the user 204 in simulating a cycling action. The cycling action enables the user 204 to workout different body portions such as an abdominal portion and a thigh portion of user 204. More specifically, with different body postures, the user 204 may workout different body portions. For example, the user 204 may lay his/her back on the floor 202 and perform the cycling action to workout a thigh portion thereof, as shown in FIG. 3. Further, a user may raise a back portion thereof from the floor 202 and perform the cycling action to workout abdominal portion thereof. After performing the workout schedule, the user 204 may fold and store the device 100 for future use. More specifically, the user 204 may fold the base 102 and the frame assembly 104 for enabling the device 100 to assume a folded position. The folded position of the base 102 and frame assembly 104 will be explained further in conjunction with FIG. 4.

Figure 4:
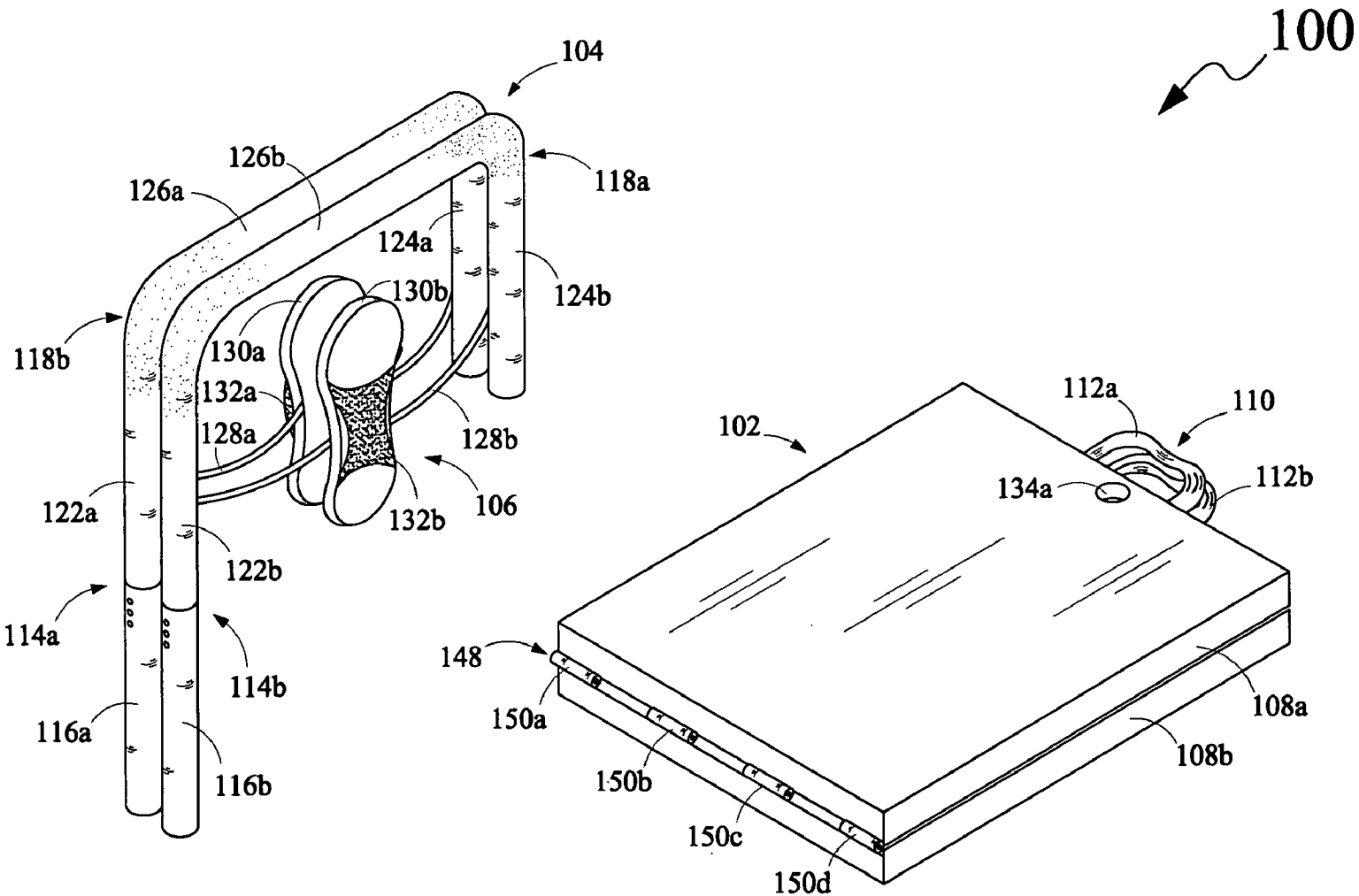
FIG. 4 illustrates a perspective view of a base and a frame assembly of the portable exercise device in a folded position, in accordance with an exemplary embodiment of the present invention.

Referring to FIG. 4, a perspective view of the base 102 and the frame assembly 104 of the device 100 in a folded position is illustrated, in accordance with an exemplary embodiment of the present invention. More specifically, FIG. 4 illustrates the base 102, detached from the frame assembly 104, and the base 102 and the frame assembly 104 assuming the folded position. For rendering the base 102 in the folded position, the first base portion 108*a* may be pivotally moved in such a manner that the first base portion 108*a* is laid on the second base portion 108*b*. As explained herein, the base 102 includes a hinge arrangement 148 configured between the first base portion 108*a* and the second base portion 108*b*. The hinge arrangement 148 pivotally couples the first base portion 108*a* with the second base portion 108*b*, thereby enabling the first base portion 108*a* to move pivotally about the second base portion 108*b*. Accordingly, the base 102 is capable of assuming an open position and the folded position by pivotal movement of the first base portion 108*a* about the second base portion 108*b*. The open position of the base 102 is explained further in conjunction with FIG. 5.

In one embodiment of the present invention, the hinge arrangement 148 includes a plurality of hinges, such as a hinge 150*a*, a hinge 150*b*, a hinge 150*c* and a hinge 150*d* for pivotally coupling the first base portion 108*a* with the second base portion 108*b*. It will be apparent to a person skilled in the art that the hinge arrangement 148 is shown to include four hinges for the purpose of illustration only. However, the hinge arrangement 148 may include more or lesser number of hinges for pivotally coupling the first base portion 108*a* with the second base portion 108*b* without departing from the scope of the present invention. The hinge arrangement 148 enables the pivotal movement between the first base portion 108*a* and the second base portion 108*b* about the hinges 150*a*, 150*b*, 150*c* and 150*d*, thereby enabling the base 102 to assume the folded position.

The frame assembly 104 may be rendered in the folded position by pivotally moving the first support member 114*a* in a manner such that the first support member 114*a* is disposed on the second support member 114*b*. More specifically, as explained in conjunction with FIG. 1, the intermediate support member 120 of the frame assembly 104 is configured with the swiveling mechanism. The swiveling mechanism enables the first support member 114*a* and the second support member 114*b* to move pivotally about the intermediate support member 120, thereby enabling the frame assembly 104 to assume the folded position.

Figure 5:
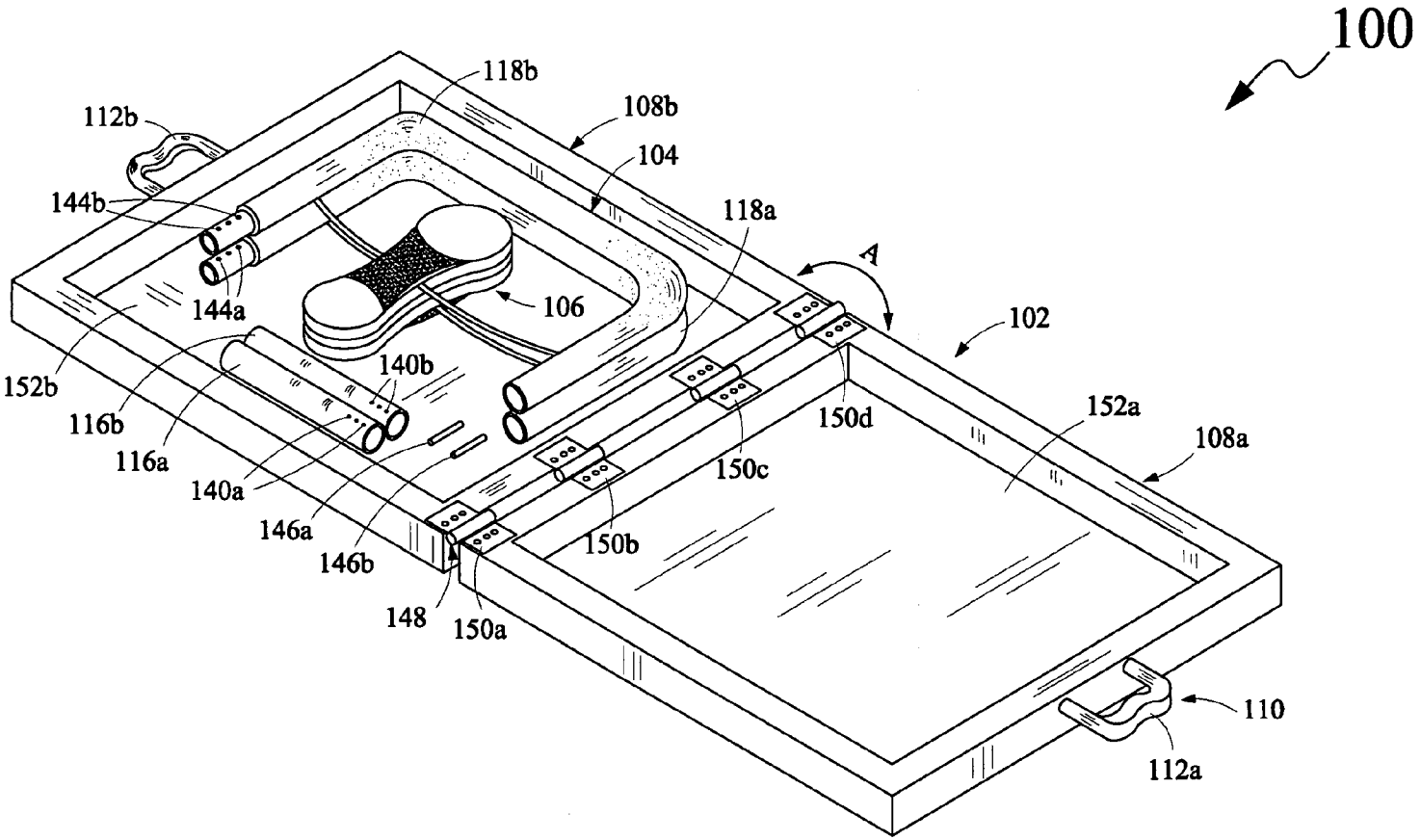
FIG. 5 illustrates a perspective view of the base of the portable exercise device in an open position for receiving the frame assembly and an exercising assembly therein, in accordance with an exemplary embodiment of the present invention.

Referring to FIG. 5, a perspective view of the base 102 of the device 100 in an open position for receiving the frame assembly 104 and the exercising assembly 106 therein is illustrated, in accordance with an exemplary embodiment of the present invention. More specifically, FIG. 5 illustrates a bottom perspective view of the base 102 of FIGS. 1-3. Further, as explained herein, each of the first base portion 108*a* and the second base portion 108*b* of the base 102 are configured with a cavity, capable of receiving the frame assembly 104 and the exercising assembly 106 therein. More specifically, the first base portion 108*a* is configured with a first cavity 152*a* and the second base portion 108*b* is configured with a second cavity 152*b*. Each cavity of the first cavitie 152*a* and the second cavity 152*b* are capable of receiving the frame assembly 104 and the exercising assembly 106 therein once the frame assembly 104 assumes the foldable position, as shown in FIG. 5.

Further, the first straight portion 116*a* and the second straight portion 116*b* of the frame assembly 104 may be detached from the first curved portion 118*a* and the second curved portion 118*b*, respectively. More specifically, the locking pin 146*a* may be removed from the holes 140*a* and 144*a* and the locking pin 146*b* may be removed from the holes 140*b* and 144*b* for detaching the first straight portion 116*a* and the second straight portion 116*b* from the first curved portion 118*a* and the second curved portion 118*b*, respectively.

Once the frame assembly 104 and the exercising assembly 106 are placed in the second cavity 152*b*, the first base portion 108*a* may be moved pivotally about the second base portion 108*b* with the help of hinge arrangement 148 for enabling the base 102 to assume the folded position, as shown in FIG. 4. The pivotal movement between the first base portion 108*a* and the second base portion 108*b* is depicted by an arrow 'A' in FIG. 5. It will be evident to a person skilled in the art that the base 102 may assume the folded position with the frame assembly 104 and the exercising assembly 106 received therein for the purpose of storing and portability of the device 100. More specifically, the folded position of the base 102 with the frame assembly 104 and the exercising assembly 106 received therein, enables the device 100 to assume a folded position which may be stored conveniently after usage thereof. The folded position of the device 100 enables the device 100 to be stored in a substantially smaller space. Further, the handle assembly 110 of the device 100 enables the user 204 (shown in FIG. 3) to conveniently carry the device 100 from one place to another.

The portable exercise device, as described herein, is light weight in construction. Accordingly, the device may be conveniently carried by the user from one place to another. More specifically, most of the components, such as the base, the frame assembly, the first platform, and the second platform of the portable exercise device may be composed of a plastic material, thereby imparting a light weight construction to the device. Further, the components of the portable exercise device may be conveniently coupled for performing workout, and thereafter may be easily decoupled and stored. The components and mechanism for configuring the portable exercise device enables the portable exercise device to be cost effective.

In an exemplary embodiment of the present invention, the portable exercise device may be configured to have following dimensions: the first support member and the second support member may have a diameter of about 1.5 inches; the first support member and the second support member may have a height of about 25 inches; the first support member and the second support member may have a collective width of about 27 inches upon coupling to configure the intermediate support member; and the first curved portion of the first support member and the second curved portion of the second support member may have a width of about 12 inches.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The embodiments were chosen and described in order to best explain the principles of the present invention and its practical application, and to thereby enable others skilled in the art to best utilize the present invention and various embodiments with various modifications as are suited to the particular use contemplated. It is understood that various omissions and substitutions of equivalents are contemplated as circumstances may suggest or render expedient, but these are intended to cover the application or implementation without departing from the spirit or scope of the claims of the present invention.

What is claimed is:

1. A portable exercise device comprising:

a. a base:

b. a frame assembly detachably coupled to the base, the frame assembly comprising i. a first support member, and ii. a second support member, the second support member coupled to the first support member configuring an intermediate support member therebetween, wherein the intermediate support member extends vertically towards the base, wherein each of the first support member and the second support member comprises an inverted J-shaped structure having, a straight portion detachably coupled to the base, and a curved portion extending from the straight portion, the curved portion is telescopically coupled to the straight portion; and c. a exercising assembly comprising i. a first stretchable member coupled to the first stretchable member, ii. a first platform coupled to the first stretchable member, iii. a second stretchable member coupled to the second support member and the intermediate support member, and iv. a second platform coupled to the second stretchable member.

2. The portable exercise device of claim 1, wherein the base comprises a. a first base portion;

b. a second base portion positioned adjacent to the first base portion; and c. a hinge arrangement configured between the first base portion and the second base portion for pivotally coupling the first base portion and the second base portion.

3. The portable exercise device of claim 2, wherein the first base portion comprises a first cavity configured within the first base portion.

4. The portable exercise device of claim 3, wherein the second base portion comprises a second cavity configured with the second base portion.

5. The portable exercise device of claim 4, wherein at least one of the first cavity and the second cavity is capable of receiving the frame assembly and the exercising assembly therein upon detaching the frame assembly from the base.

6. The portable exercise device of claim 2, wherein the base further comprises a handle assembly for carrying the portable exercise device.

7. The portable exercise device of claim 1, wherein each of the first platform and the second platform comprises a fastening mechanism for removably securing a foot of a user thereto.

8. The portable exercise device of claim 1, wherein each of the first support member and the second support member is composed of a plastic material.

* * * * *